US011011880B2

(12) United States Patent
Gassner

(10) Patent No.: US 11,011,880 B2
(45) Date of Patent: May 18, 2021

(54) CONNECTING CABLE, CONNECTING CABLE ASSEMBLY, AND DRIVING SYSTEM

(71) Applicant: limoss (Dongguan) Co., Ltd., Guangdong (CN)

(72) Inventor: Christian Gassner, Guangdong (CN)

(73) Assignee: limoss (Dongguan) Co., Ltd., Dongguan (CN)

( * ) Notice: Subject to any disclaimer, the term of this patent is extended or adjusted under 35 U.S.C. 154(b) by 195 days.

(21) Appl. No.: 16/305,888

(22) PCT Filed: Dec. 2, 2016

(86) PCT No.: PCT/CN2016/108393
§ 371 (c)(1),
(2) Date: Nov. 29, 2018

(87) PCT Pub. No.: WO2018/098812
PCT Pub. Date: Jun. 7, 2018

(65) Prior Publication Data

US 2020/0321740 A1 Oct. 8, 2020

(51) Int. Cl.
*H01R 31/02* (2006.01)
*H01R 31/06* (2006.01)

(52) U.S. Cl.
CPC ..... *H01R 31/02* (2013.01); *H01R 31/06* (2013.01)

(58) Field of Classification Search
CPC ..... H01R 31/02; H01R 31/06
USPC ..... 439/502
See application file for complete search history.

(56) References Cited

U.S. PATENT DOCUMENTS 2,774,048 A * 12/1956 Baenziger ..... F21L 14/02 439/476.1
3,359,527 A * 12/1967 Hart ..... H01R 25/003 439/588
3,668,602 A * 6/1972 Griffin ..... F21V 23/00 439/107
4,369,487 A * 1/1983 Carlow ..... F21V 27/00 362/258

(Continued)

FOREIGN PATENT DOCUMENTS

CN 204349147 U 5/2015
CN 204885569 U 12/2015

OTHER PUBLICATIONS

International Search Report of PCT Patent Application No. PCT/CN2016/108393 dated May 27, 2017.

*Primary Examiner* — Alexander Gilman

(57) ABSTRACT

A connecting cable (20), comprising: a first end (21) which is arranged with a first interface (23) and a second interface (24) coupled with each other, and a second end (22) which is arranged with a third interface (25) having a centrosymmetric cross section, wherein every two interfaces of the first, the second and the third interfaces (23, 24, 25) are in electrical communication, and the third interface (25) is connected with at least one of the first and the second interfaces (23, 24) by pluggable connection. When supplying driving circuits for actuators, each subsequent actuator can be parallelly connected through one connecting cable (20) with another connecting cable (20) of preceding actuator. In such a manner, disorders of cables in the fields can be avoided, whereby the risk of making mistakes during assembly and maintenance can be lowered. The cables can be neatly arranged in the fields.

20 Claims, 6 Drawing Sheets

(56) References Cited

U.S. PATENT DOCUMENTS 5,775,939 A * 7/1998 Brown ..... G06F 1/266 439/502
5,833,357 A * 11/1998 Ting ..... F21L 14/02 362/378
6,111,772 A * 8/2000 Lee ..... H01R 25/00 363/100
6,280,243 B1 * 8/2001 Liu ..... H01R 9/032 439/502
6,623,295 B2 * 9/2003 DeLadurantaye, III ..... H01R 24/40 439/502
6,746,273 B1 * 6/2004 Liu ..... H04L 12/10 439/502
6,817,729 B2 * 11/2004 Lebel ..... H01F 27/04 315/255
7,635,208 B2 * 12/2009 Hedrick ..... F21L 14/02 16/110.1
7,988,494 B2 * 8/2011 Lee ..... H01R 25/003 439/652
8,007,130 B2 * 8/2011 Wu ..... H01R 24/30 362/249.14
8,317,374 B2 * 11/2012 Hedrick ..... F21V 15/02 362/398
8,574,010 B2 * 11/2013 Wu ..... H01R 25/003 439/654
8,714,999 B1 * 5/2014 Wu ..... H01R 13/72 439/502
8,727,804 B2 * 5/2014 McNeely ..... A61G 7/005 439/505
8,888,524 B2 * 11/2014 Martin ..... H01R 13/72 439/502
8,951,076 B2 * 2/2015 Tso ..... H01R 13/5205 439/694
9,463,564 B2 * 10/2016 Macauda ..... B25F 5/00
2002/0189848 A1 * 12/2002 Hawker ..... H01R 31/02 174/149 B
2004/0092158 A1 * 5/2004 Chien ..... H01R 31/06 439/505
2004/0248462 A1 * 12/2004 Dyer ..... H01R 29/00 439/502
2005/0135108 A1 * 6/2005 Delano ..... F21V 21/0885 362/396
2014/0024247 A1 * 1/2014 Riesgaard ..... H01R 11/01 439/502
2014/0065886 A1 * 3/2014 Lee ..... H01R 27/02 439/628
2015/0111418 A1 * 4/2015 Vallon ..... H01R 13/72 439/501

* cited by examiner

CONNECTING CABLE, CONNECTING CABLE ASSEMBLY, AND DRIVING SYSTEM

FIELD OF THE INVENTION

The present invention relates to electric power transmission devices, more particularly to a connecting cable, a connecting cable assembly, and a driving system.

BACKGROUND OF THE INVENTION

The actuator is an electromotive transmission device used for lifting, lowering or rotating equipment such as medical beds, electric beds and household massage chairs. Usually, a power supply is required to actually actuate the actuator. In order to connect an actuator to a conventional house circuit and actuate it to work, it is necessary to arrange a transformer for transforming house circuit therebetween, so as to enable the house circuit to supply stable power source for the actuator. Currently there are two types of connecting cables for actuators.

1. One type of connecting cables may be arranged with a power plug at one end, and at the other end with a sole male plug that may be connected to an actuator. Each actuator is configured individually with a respective connecting cable. In the case that a plurality of actuators are provided, a plurality of individual connecting cables are required. In such case, too many connecting cables lead to a waste of resource, and cause confusion in the application fields and also easily cause mistakes during assembly and maintenance.

2. Another type of connecting cables may be arranged with a power plug at one end, and at the other end with a plurality of male plugs that may be connected to a plurality of actuators respectively. However, since the number of actuators of the equipment in field applications usually is not equal to the number of male plugs, plugs may be not enough, or in excess, which also cause confusion in the application fields and easily cause mistakes during assembly and maintenance.

SUMMARY OF THE INVENTION

The present invention aims to provide a connecting cable, a connecting cable assembly, and a driving system, to solve the problem of conventional driving circuits for actuators that confusions and disorders of the cables in the fields may result in mistakes during assembly and maintenance.

The present invention provides a connecting cable, comprising a first end which is arranged with a first interface and a second interface coupled with each other, and a second end which is arranged with a third interface having a centrosymmetric cross section, wherein every two interfaces of the first interface, the second interface and the third interface are in electrical communication with each other, and the third interface is configured to be connected with at least one of the first interface and the second interface by pluggable connection.

The present invention further provides a connecting cable assembly, comprising a main transmission cable and the above connecting cable, wherein the main transmission cable is arranged at one end with a power plug, and at the other end with an output interface which is configured to be identical to the third interface.

The present invention further provides a driving system, comprising the above connecting cable assembly, wherein the connecting cable assembly comprises N connecting cables, by which N connecting cables N+1 loads can be driven.

Herein, in the case that N equals to 1, the first interface of the connecting cable can be connected with the output interface of the main transmission cable by pluggable connection, the second interface can be electrically connected with the first load, and the third interface can be electrically connected with the second load. In the case that N is a positive integer no less than 2, the second interfaces of the first to Nth connecting cables can be electrically connected with the first to Nth loads in one-to-one correspondence respectively. Herein, the third interface of each preceding connecting cable of the first to N−1th connecting cables is connected with the first interface of respective subsequent connecting cable by pluggable connection. Herein, the first interface of the first connecting cable is connected with the output interface of the main transmission cable by pluggable connection, and the N+1th load is electrically connected with the third interface of the Nth connecting cable.

When supplying driving circuits for a plurality of actuators, by means of the connecting cable and the connecting cable assembly as mentioned above, each subsequent actuator can be connected through one connecting cable with a connecting cable of respective preceding actuator or with the main transmission cable in parallel. In such a manner, confusions and disorders of the cables in the fields can be avoided, whereby the risk of making mistakes during assembly and maintenance can be lowered. The cables can be neatly arranged in the fields, and are convenient to assembly and disassembly. Moreover, since the third interface for parallel connection has a centrosymmetric structure in cross section and has no different between the front and back sides of the interface, it is convenient to use, and the risk of damage caused by reverse connection of the interface is avoided.

DETAILED DESCRIPTION OF ILLUSTRATED EMBODIMENTS

In order to illustrate technical problems to be solved, technical solutions and advantages more clearly, the present invention is further described below in conjunction with figures and embodiments. It should be understood that particular embodiments described herein are illustrative rather than limiting.

Figure 1:
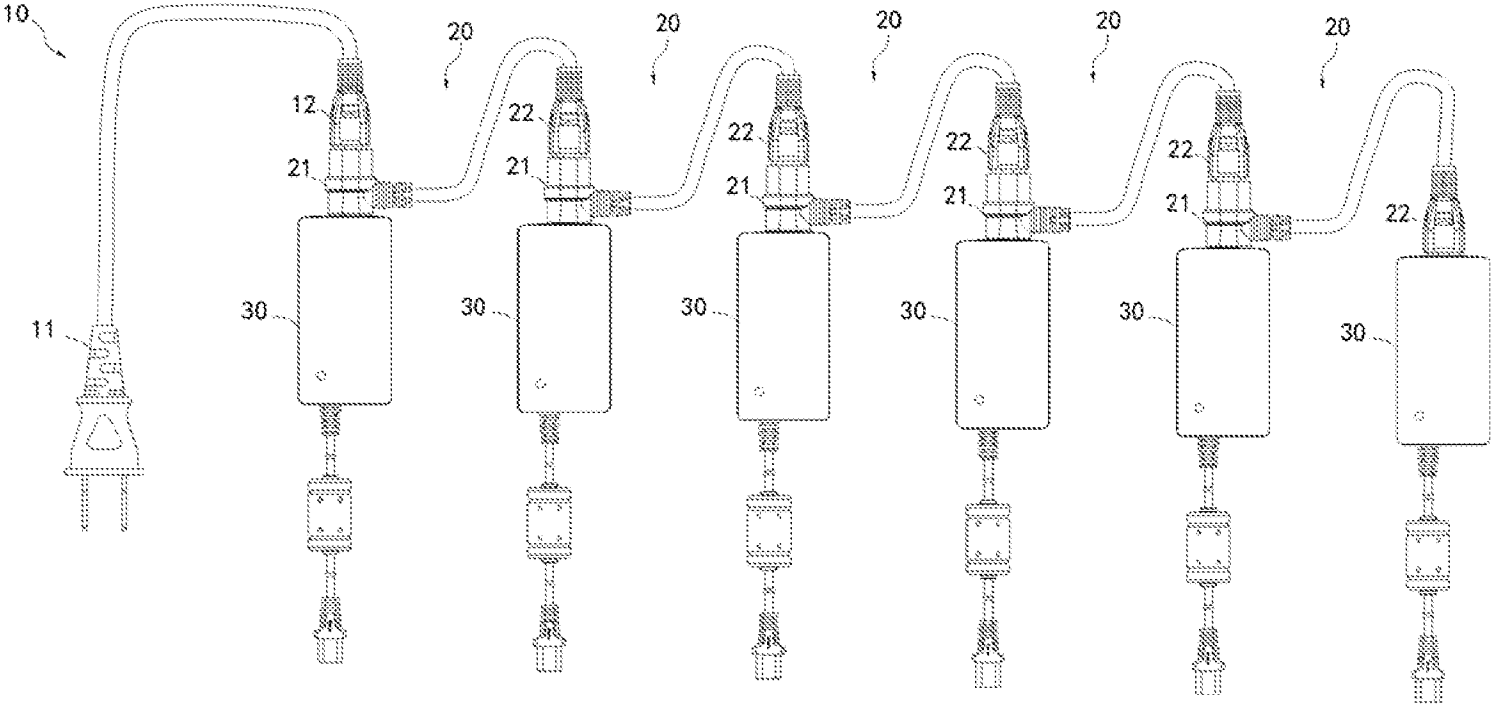
FIG. 1 is a schematic drawing illustrating a connecting cable assembly used for actuating a plurality of actuators according to a preferred embodiment of the present invention.
Figure 2:
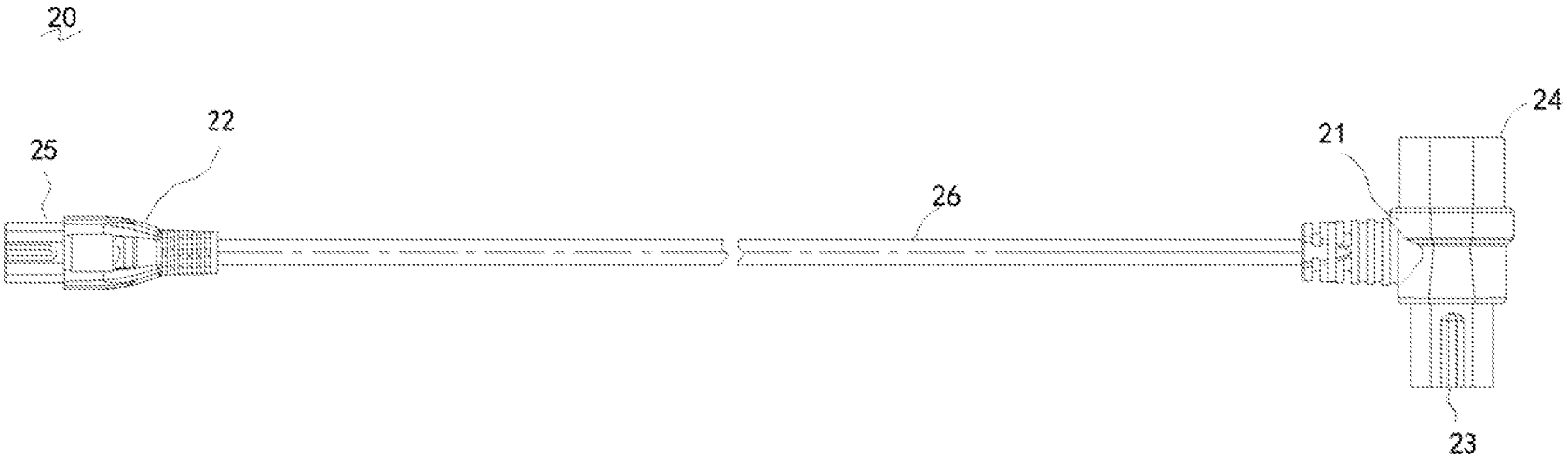
FIG. 2 is a schematic drawing of a connecting cable according to a preferred embodiment of the present invention.

Referring to FIGS. 1 and 2, a connecting cable assembly according to a preferred embodiment of the present invention comprises a main transmission cable 10 and at least one connecting cable 20, wherein the main transmission cable 10 is arranged at one end with a power plug 11, and at the other end with an output interface 12 which is identical to a third interface 25 of the connecting cable 20 and is electrically connected with one first interface 23.

The connecting cable 20 comprises a first end 21 and a second end 22. The first end 21 is arranged with a first interface 23 and a second interface 24 which are coupled with each other. In the embodiment, the first interface 23 and the second interface 24 are fixed to a main body of the first end 21 and are respectively arranged at opposite ends of the main body. In other embodiments, the first interface 23 may be arranged at one end of the main body while the second interface 24 may be arranged at one side of the main body, such that two lines respectively connecting each of the two interfaces with the center of the main body form an angle, for example an angle of 90°.

The second end 22 is arranged with a third interface 25 having a centrosymmetric cross section, and every two interfaces of the first interface 23, the second interface 24, and the third interface 25 are in electrical communication with each other. In the embodiment, the second end 22 and the first end 21 are connected by a wire cable 26. In other embodiments, the second end 22 and the first end 21 may be fixed on a same main body, with three interfaces being arranged around the main body, respectively.

The third interface 25 is configured to be connected with at least one of the first interface 23 and the second interface 24 by pluggable connection. This has the effect that, when supplying driving circuits for a plurality of loads (for example transformers 30), each subsequent transformer 30 can be electrically connected, by its connecting cable 20, with a connecting cable 20 of respective preceding transformer 30 or with the main transmission cable 10. Hypothetically, if the first interface 23 can be connected with the third interface 25 by pluggable connection, the second interface 24 can serve as an interface for electrically connecting with the transformer 30, and vice versa.

For example, referring to FIG. 1, in order to supply driving circuits for six actuators (not shown), each of the actuators may be correspondingly connected to one end of one transformer 30, respectively. Herein, six above-mentioned connecting cables 20 are provided, wherein the other end of the first transformer 30 is electrically connected with the second interface 24 of the first connecting cable 20, the first interface 23 of the first connecting cable 20 is electrically connected with the output interface 12 of the main transmission cable 10, the third interface 25 of the first connecting cable 20 is electrically connected with the first interface 23 of the second connecting cable 20, the second interface 24 of the second connecting cable 20 is electrically connected with the second transformer 30, and so on, and the sixth transformer 30 is directly electrically connected with the third interface 25 of the sixth connecting cable 20. In such an arrangement, six transformers 30 are incorporated in the circuit by six connecting cables 20, with no excess interface or cable being left. In such a manner, the cables can be neatly arranged in the fields, whereby the risk of making mistakes during assembly and maintenance is lowered.

In the embodiment of the present invention, the first interface 23 and the third interface 25 of the connecting cable 20 can be connected with each other by pluggable connection, and the second interface 24 may be used for connecting a load. In this case, one of the first interface 23 and the third interface 25 is configured as a male plug and the other one is configured as a female socket, and the second interface 24 may be configured as needed, to be identical to the first interface 23 or the third interface 25, or different from them, which is not limited herein. Preferably, when driving a plurality of loads of the same type, the third interface 25 and the second interface 24 are configured identically.

Figure 3:
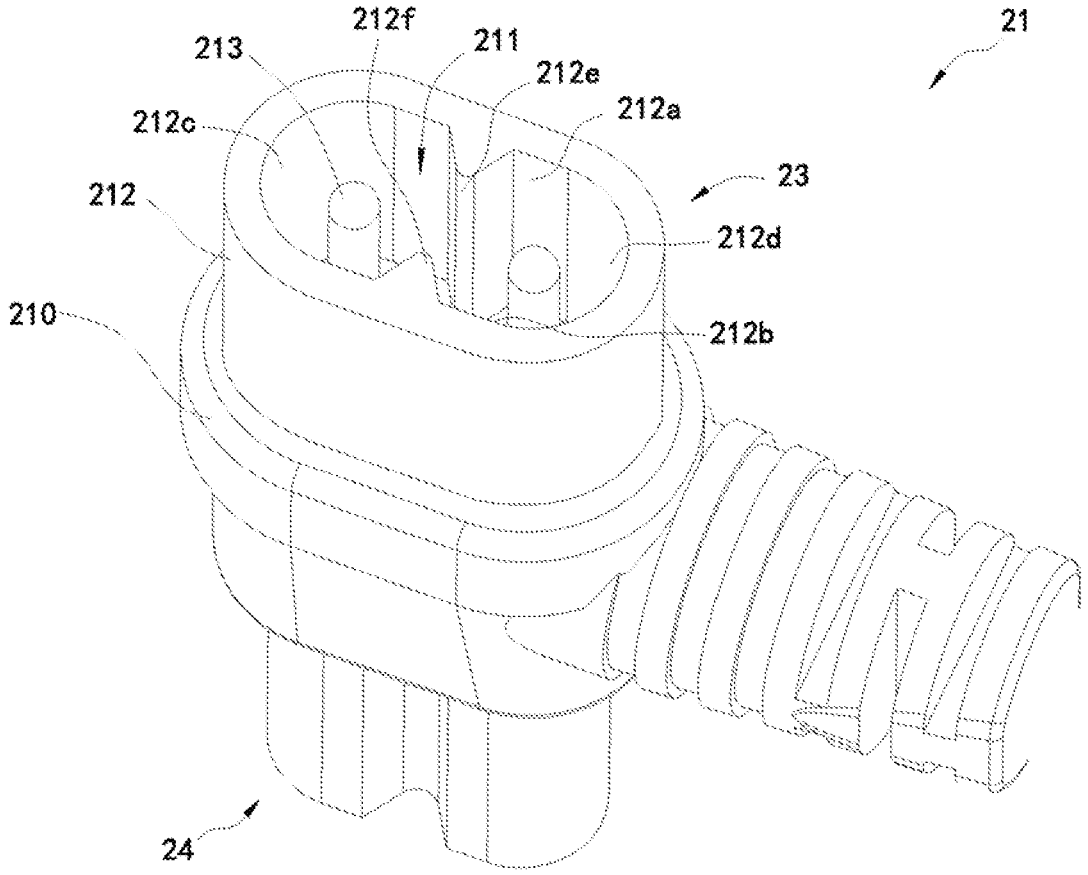
FIG. 3 is a schematic drawing of a first interface of a connecting cable according to a first embodiment of the present invention, wherein the first interface is configured as a female socket.

In an embodiment, the first interface 23 and/or the second interface 24 are configured as female sockets. For example, the first interface 23 is configured as a female socket as shown in FIG. 3, the first end 21 comprises a first main body 210, the first interface 23 is provided with a first opening 211 formed on one side of the first main body 210 and longitudinally extending inwards from a surface of the side, a first insulating frame 212 defining a shape of the first interface 23, and at least one electrode 213 fixed to the first insulating frame 212 and disposed inside the first opening 211. Herein, the first insulating frame 212 has a bottom wall (not shown) at the inner end, and a plurality of inner walls connected with the bottom wall and longitudinally extending outwards, wherein the plurality of inner walls comprise a first and a second inner walls 212*a*, 212*b* which are opposite to each other, and a third and a fourth inner walls 212*c*, 212*d* which extend between the first and the second inner walls 212*a*, 212*b* and are opposite to each other.

Figure 4:
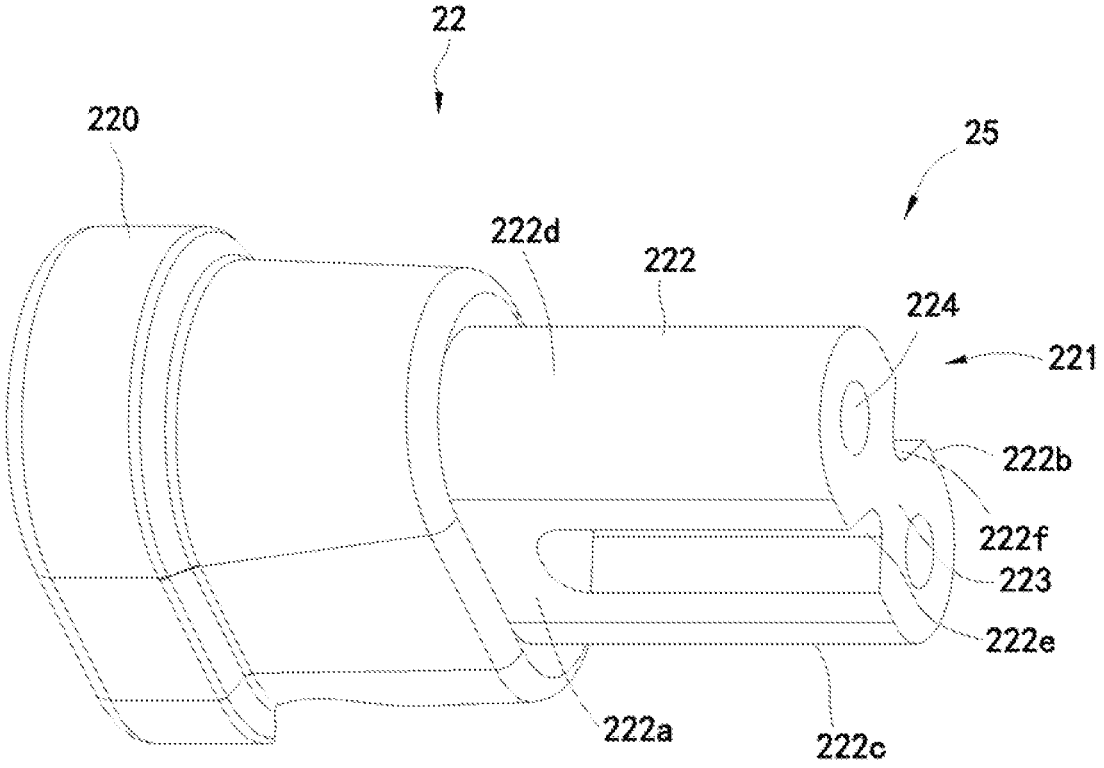
FIG. 4 is a schematic drawing of a third interface of the connecting cable according to the first embodiment of the present invention, wherein the third interface is configured as a male plug.

Correspondingly, the third interface 25 may be configured as a male plug. Referring to FIG. 4, the second end 22 comprises a second main body 220, the third interface 25 is arranged with a plug portion 221 coupled at one side of the second main body 220 and longitudinally extending outwards from the said side, and at least one electrode contact (not shown) formed at the plug portion 221. The plug portion 221 has a width, a height, and a length, and comprises a second insulating frame 222 defining a shape of the plug portion 221, wherein the second insulating frame 222 has a first and a second side surfaces 222*a*, 222*b* which extend along the width direction and the length direction and are opposite to each other, a third and a fourth side surfaces 222*c*, 222*d* which extend between the first and the second side surfaces 222*a*, 222*b* along the height direction and the length direction and are opposite to each other, and an end portion 223 extending along the width direction and the height direction at the outer end of the second insulating frame 222.

In the embodiment, the electrode 213 may be an electrode pin, which is fixed to the bottom wall of the insulating frame 212 and longitudinally extends outwards. Correspondingly, the outer end surface of the end portion 223 of the second insulating frame 222 of the third interface 25 is provided with at least one second opening 224, which opening extends towards the second main body 220, and the electrode contact is formed on the inner wall of the second opening 224. The electrode contact is attached on the inner wall of the second opening 224 in the form of a patch, and the second opening 224 has an aperture diameter fitting with the electrode pin. In other embodiments, the electrode 213 may be a metal contact formed on the bottom wall of the insulating frame 212, and correspondingly the electrode contact of the third interface 25 may be a metal contact formed on the outer end surface of the end portion 223.

In another embodiment, referring to FIGS. 3 and 4, the joint regions, where the first and the second inner walls 212*a*, 212*b* of the insulating frame 212 of the interface which serves as a female socket are respectively connected with the third and the fourth inner walls 212*c*, 212*d*, may be rounded. Alternatively, the third and the fourth inner walls 212*c*, 212*d* may be arc-shaped. Correspondingly, the joint regions, where the first and the second side surfaces 222*a*, 222*b* of the insulating frame 222 of the plug portion 221 which serves as a male plug are respectively connected with the third and the fourth side surfaces 222*c*, 222*d*, may also be rounded. Alternatively, the third and the fourth side surfaces 222*c*, 222*d* may be arc-shaped surfaces. Such arrangement is beneficial to protect the male plug or the female socket, reducing damage to the corners from stubbing.

Furthermore, protruding ribs 212*e*, 212*f* are respectively arranged in the middle parts of the first and the second inner walls 212*a*, 212*b* of the insulating frame 212 of the interface which serves as a female socket, and the two protruding ribs 212*e*, 212*f* are formed opposite to each other and extend towards the bottom wall (the main body 210) from the outer end surface. Correspondingly, grooves 222*e*, 222*f* are respectively provided in the middle parts of the first and the second side surfaces 222*a*, 222*b* of the insulating frame 222 of the interface which serves as a male plug, and the two grooves 222*e*, 222*f* extend towards the main body 220 from the outer end surface. In such configuration, due to the protruding ribs 212*e*, 212*f* arranged on the female socket and the corresponding grooves 222*e*, 222*f* arranged on the male plug, it is beneficial to reinforce the female socket and the male plug, reducing deformation and breakage caused by external pulling and pushing forces.

Figure 5:
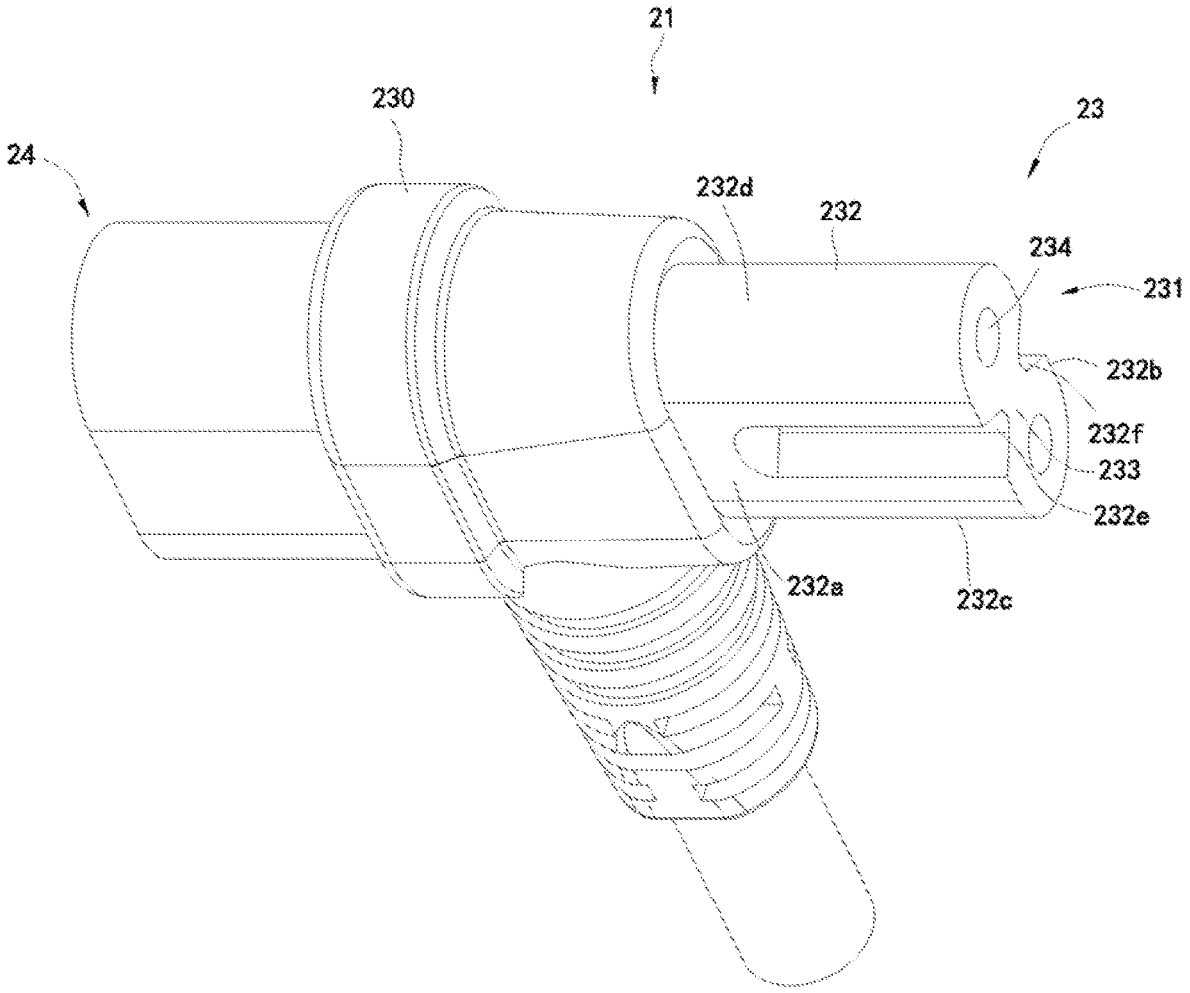
FIG. 5 is a schematic drawing of a first interface of a connecting cable according to a second embodiment of the present invention, wherein the first interface is configured as a male plug.

In another embodiment, the first interface 23 and/or the second interface 24 are male plugs. For example, the first interface 23 is configured as a male plug as shown in FIG. 5, the first end 21 comprises a first main body 230, the first interface 23 is arranged with a plug portion 231 coupled at one side of the first main body 230 and longitudinally extending outwards from the said side, and at least one electrode contact formed at the plug portion 231. The plug portion 231 has a width, a height, and a length, and comprises a first insulating frame 232 defining a shape of the first interface 23, wherein the first insulating frame 232 has a first and a second side surfaces 232*a*, 232*b* which extend along the width direction and the length direction and are opposite to each other, a third and a fourth side surfaces 232*c*, 232*d* which extend between the first and the second side surfaces 232*a*, 232*b* along the height direction and the length direction and are opposite to each other, and an end portion 233 extending along the width direction and the height direction at the outer end of the first insulating frame 232.

In the embodiment, the outer end surface of the end portion 233 of the first insulating frame 232 is provided with at least one first opening 231, which opening extends towards the first main body 230, and the electrode contact is formed on the inner wall of the first opening 231. In other embodiments, the electrode contact may be formed on the outer end surface of the end portion 233 of the first insulating frame 232.

Figure 6:
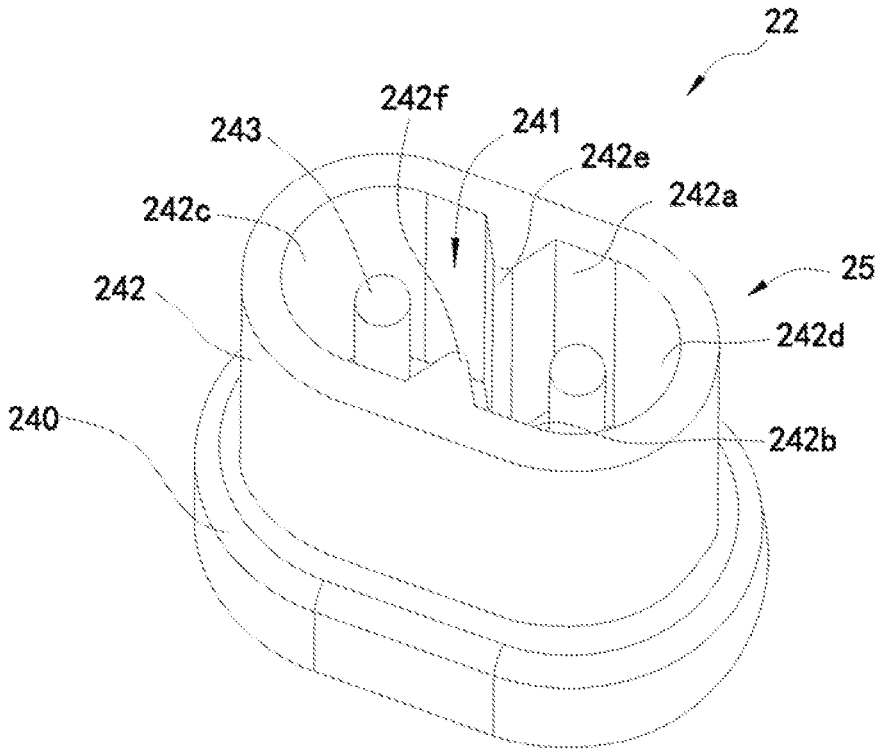
FIG. 6 is a schematic drawing of a third interface of the connecting cable according to the second embodiment of the present invention, wherein the third interface is configured as a female socket.

Correspondingly, the third interface 25 may be a female socket. Referring to FIG. 6, the second end 22 comprises a second main body 240, the third interface 25 is provided with a second opening 244 formed on one side of the second main body 240 and longitudinally extending inwards from a surface of the said side, a second insulating frame 242 defining a shape of the third interface 24, and at least one electrode 243 fixed to the second insulating frame 242 and disposed inside the second opening 244. Herein, the second insulating frame 242 has a bottom wall at the inner end, and a plurality of inner walls connected with the bottom wall and longitudinally extending outwards, wherein the plurality of inner walls comprise a first and a second inner walls 242*a*, 242*b* which are opposite to each other, and a third and a fourth inner walls 242*c*, 242*d* which extend between the first and the second inner walls 242*a*, 242*b* and are opposite to each other.

In the embodiment, the electrode 243 may be an electrode pin, which is fixed to the bottom wall of the second insulating frame 242 and longitudinally extends outwards. In other embodiments, the electrode 243 may be a metal contact formed on the bottom wall of the insulating frame 242.

Furthermore, referring to FIGS. 1 and 2, a driving system is further provided, which comprises the connecting cable assembly as mentioned above, wherein the connecting cable assembly comprises N connecting cables 20 for driving N+1 loads, wherein N is a positive integer no less than 1.

In particular, in the case that N equals to 1, the first interface 23 of the connecting cable 20 can be connected with the output interface 12 of the main transmission cable 10 by pluggable connection, the second interface 24 can be electrically connected with the first load, and the third interface 25 can be electrically connected with the second load. In the case that N is a positive integer no less than 2, the second interface 24 of each connecting cable 20 of the first to Nth connecting cables, is electrically interconnected with respective load of the first to Nth loads in one-to-one correspondence, in particular by pluggable connection. Herein, the third interface 25 of each preceding connecting cable 20 of the first to N−1th connecting cables 20 is connected with the first interface 23 of respective subsequent connecting cable 20 by pluggable connection. Herein, the first interface 23 of the first connecting cable 20 is connected with the output interface 12 of the main transmission cable 10 by pluggable connection, and the N+1th load is electrically connected with the third interface 25 of the Nth connecting cable 20.

In the embodiment, the loads are transformers 30. Furthermore, another end of each transformer 30 is connected to a corresponding actuator, respectively. Of course, the loads themselves may be actuators or transformers 30 in some cases, that is, transformers 30 can be omitted when the supply voltage transmitted by the main transmission cable 10 matches the actuators. Moreover, the second interface 24 and the third interface 25 are interfaces of the same type, and the first interface 23 and the third interface 25 are male and female socket interfaces matching with each other.

When supplying driving circuits for a plurality of actuators, by means of the connecting cable 20 and the connecting cable assembly, each subsequent actuator can be connected through one connecting cable 20 and one transformer 30 with the corresponding connecting cable 20 of respective preceding actuator in parallel. In such a manner, confusions and disorders of the cables in the fields can be avoided, whereby the risk of making mistakes during assembly and maintenance is lowered. The cables can be neatly arranged in the fields. Moreover, since the third interface 25 for parallel connection has a centrosymmetric structure in cross section and has no different between the front and back sides of the interface, it is convenient to use, and the risk of damage caused by reverse connection of the interface is avoided.

All the above merely illustrate preferred embodiments of the present invention, but are not to limit the invention in any form. The present invention is intended to cover all changes, equivalent arrangements and various modifications included within the spirit and principle of the present invention.

The invention claimed is:

1. A connecting cable, comprising:

a first end which is arranged with a first interface and a second interface coupled with each other, a second end which is arranged with a third interface having a centrosymmetric cross section, wherein every two interfaces of the first interface, the second interface and the third interface are in electrical communication with each other, and the third interface is configured such that it can be connected with at least one of the first interface and the second interface by pluggable connection;

the first interface and/or the second interface are female sockets or male plugs, the third interface is a male plug or a female socket correspondingly;

the interface which serves as the female socket has a female insulating frame, the female insulating frame has a bottom wall at an inner end, and a plurality of inner walls connected with the bottom wall and longitudinally extending outwards, wherein the plurality of inner walls comprise a first and a second inner walls which are opposite to each other, and a third and a fourth inner walls which extend between the first and the second inner walls and are opposite to each other; protruding ribs are respectively arranged in the middle parts of the first and the second inner walls;

the interface which serves as the male plug has a male insulating frame, the male insulating frame has a first and a second side surfaces which extend along the width direction and the length direction and are opposite to each other, a third and a fourth side surfaces which extend between the first and the second side surfaces along the height direction and the length direction and are opposite to each other, and an end portion extending along the width direction and the height direction at an outer end of the male insulating frame, grooves corresponding to protruding ribs are respectively provided in the middle parts of the first and the second side surfaces.

2. The connecting cable according to claim 1, wherein the third interface and the second interface are configured identically, and the third interface and the first interface can be connected with each other by pluggable connection.

3. A connecting cable assembly, comprising a main transmission cable and at least one connecting cable according to claim 2, wherein the main transmission cable is arranged at one end with a power plug, and at the other end with an output interface which is configured to be identical to the third interface.

4. A driving system, comprising a connecting cable assembly according to claim 3, wherein the connecting cable assembly comprises N connecting cables by which N+1 loads can be driven;

when N equals to 1, the first interface of the connecting cable can be connected with the output interface of the main transmission cable by pluggable connection, the second interface can be electrically connected with the first load, and the third interface can be electrically connected with the second load;

when N is a positive integer no less than 2, the second interfaces of the first to Nth connecting cables can be electrically connected with the first to Nth loads in one-to-one correspondence respectively, wherein the third interface of a preceding connecting cable of the first to N−1th connecting cables is connected with the first interface of a subsequent connecting cable by pluggable connection, wherein the first interface of the first connecting cable is connected with the output interface of the main transmission cable by pluggable connection, and the N+1th load is electrically connected with the third interface of the Nth connecting cable.

5. The connecting cable according to claim 1, wherein the first end comprises a first main body, the first interface and/or the second interface are female sockets and respectively provided with a first opening formed on one side of the first main body and longitudinally extending inwards from a surface of the side, a first insulating frame defining a shape of the first interface, the first insulating frame is the female insulating frame, and at least one electrode fixed to the first insulating frame and disposed inside the first opening, wherein the first insulating frame has a bottom wall at an inner end, and a plurality of inner walls connected with the bottom wall and longitudinally extending outwards, wherein the plurality of inner walls comprise a first and a second inner walls which are opposite to each other, and a third and a fourth inner walls which extend between the first and the second inner walls and are opposite to each other.

6. A connecting cable assembly, comprising a main transmission cable and at least one connecting cable according to claim 5, wherein the main transmission cable is arranged at one end with a power plug, and at the other end with an output interface which is configured to be identical to the third interface.

7. A driving system, comprising a connecting cable assembly according to claim 6, wherein the connecting cable assembly comprises N connecting cables by which N+1 loads can be driven;

when N equals to 1, the first interface of the connecting cable can be connected with the output interface of the main transmission cable by pluggable connection, the second interface can be electrically connected with the first load, and the third interface can be electrically connected with the second load;

when N is a positive integer no less than 2, the second interfaces of the first to Nth connecting cables can be electrically connected with the first to Nth loads in one-to-one correspondence respectively, wherein the third interface of a preceding connecting cable of the first to N−1th connecting cables is connected with the first interface of a subsequent connecting cable by pluggable connection, wherein the first interface of the first connecting cable is connected with the output interface of the main transmission cable by pluggable connection, and the N+1th load is electrically connected with the third interface of the Nth connecting cable.

8. The connecting cable according to claim 6, wherein the electrode is an electrode pin, which is fixed to the bottom wall of the first insulating frame and longitudinally extends outwards.

9. A connecting cable assembly, comprising a main transmission cable and at least one connecting cable according to claim 8, wherein the main transmission cable is arranged at one end with a power plug, and at the other end with an output interface which is configured to be identical to the third interface.

10. The connecting cable according to claim 8, wherein the second end comprises a second main body, the third interface is the male plug and arranged with a plug portion coupled at one side of the second main body and longitudinally extending outwards from the side, and at least one electrode contact formed at the plug portion, wherein the plug portion has a width, a height, and a length, and comprises a second insulating frame defining a shape of the plug portion, the second insulating frame is the male insulating frame, wherein the second insulating frame has a first and a second side surfaces which extend along the width direction and the length direction and are opposite to each other, a third and a fourth side surfaces which extend between the first and the second side surfaces along the height direction and the length direction and are opposite to each other, and an end portion extending along the width direction and the height direction at an outer end of the second insulating frame.

11. A connecting cable assembly, comprising a main transmission cable and at least one connecting cable according to claim 10, wherein the main transmission cable is arranged at one end with a power plug, and at the other end with an output interface which is configured to be identical to the third interface.

12. The connecting cable according to claim 1, wherein the first end comprises a first main body, the first interface and/or the second interface are the male plugs and respectively arranged with a plug portion coupled at one side of the first main body and longitudinally extending outwards from the side, and at least one electrode contact formed at the plug portion, wherein the plug portion has a width, a height, and a length, and comprises a first insulating frame defining a shape of the first interface, the first insulating frame is the male insulating frame, wherein the first insulating frame has a first and a second side surfaces which extend along the width direction and the length direction and are opposite to each other, a third and a fourth side surfaces which extend between the first and the second side surfaces along the height direction and the length direction and are opposite to each other, and an end portion extending along the width direction and the height direction at an outer end of the first insulating frame.

13. A connecting cable assembly, comprising a main transmission cable and at least one connecting cable according to claim 12, wherein the main transmission cable is arranged at one end with a power plug, and at the other end with an output interface which is configured to be identical to the third interface.

14. The connecting cable according to claim 12, wherein an outer end surface of the end portion of the first insulating frame is provided with at least one first opening extending towards the first main body, and the electrode contact is formed on an inner wall of the first opening.

15. The connecting cable according to claim 14, wherein the second end comprises a second main body, the third interface is the female socket and provided with a second opening formed on one side of the second main body and longitudinally extending inwards from a surface of the said side, a second insulating frame defining a shape of the third interface, the second insulating frame is the female insulating frame, and at least one electrode fixed to the second insulating frame and disposed inside the second opening, wherein the second insulating frame has a bottom wall at an inner end, and a plurality of inner walls connected with the bottom wall and longitudinally extending outwards, wherein the plurality of inner walls comprise a first and a second inner walls which are opposite to each other, and a third and a fourth inner walls which extend between the first and the second inner walls and are opposite to each other.

16. A connecting cable assembly, comprising a main transmission cable and at least one connecting cable according to claim 15, wherein the main transmission cable is arranged at one end with a power plug, and at the other end with an output interface which is configured to be identical to the third interface.

17. A connecting cable assembly, comprising a main transmission cable and at least one connecting cable according to claim 14, wherein the main transmission cable is arranged at one end with a power plug, and at the other end with an output interface which is configured to be identical to the third interface.

18. A connecting cable assembly, comprising a main transmission cable and at least one connecting cable according to claim 1, wherein the main transmission cable is arranged at one end with a power plug, and at the other end with an output interface which is configured to be identical to the third interface.

19. A driving system, comprising a connecting cable assembly according to claim 18, wherein the connecting cable assembly comprises N connecting cables by which N+1 loads can be driven;

when N equals to 1, the first interface of the connecting cable can be connected with the output interface of the main transmission cable by pluggable connection, the second interface can be electrically connected with the first load, and the third interface can be electrically connected with the second load;

when N is a positive integer no less than 2, the second interfaces of the first to Nth connecting cables can be electrically connected with the first to Nth loads in one-to-one correspondence respectively, wherein the third interface of a preceding connecting cable of the first to N−1th connecting cables is connected with the first interface of a subsequent connecting cable by pluggable connection, wherein the first interface of the first connecting cable is connected with the output interface of the main transmission cable by pluggable connection, and the N+1th load is electrically connected with the third interface of the Nth connecting cable.

20. The driving system according to claim 19, wherein the loads are transformers.

* * * * *